US007439925B2

(12) United States Patent
Huang et al.

(10) Patent No.: US 7,439,925 B2
(45) Date of Patent: Oct. 21, 2008

(54) DUAL BAND CORRUGATED FEED HORN ANTENNA

(75) Inventors: Chih-Yung Huang, Taipei Hsien (TW); Chang-Hsiu Huang, Taipei Hsien (TW)

(73) Assignee: Wistron Neweb Corporation, Taipei Hsien (TW)

( * ) Notice: Subject to any disclaimer, the term of this patent is extended or adjusted under 35 U.S.C. 154(b) by 0 days.

(21) Appl. No.: 11/797,912

(22) Filed: May 8, 2007

(65) Prior Publication Data

US 2008/0068275 A1 Mar. 20, 2008

(30) Foreign Application Priority Data

May 9, 2006 (TW) ..... 95116322 A

(51) Int. Cl.
*H01Q 13/02* (2006.01)

(52) U.S. Cl. ..... 343/786; 343/772; 333/21 A

(58) Field of Classification Search ..... 343/786, 343/772, 840, 776; 333/21 A, 21 R
See application file for complete search history.

(56) References Cited

U.S. PATENT DOCUMENTS

| | | | | |
|---|---|---|---|---|
| 4,199,764 A | | 4/1980 | Williams et al. | 343/786 |
| 4,356,495 A | * | 10/1982 | Morz | 343/786 |
| 5,461,394 A | * | 10/1995 | Weber | 343/786 |
| 5,486,839 A | * | 1/1996 | Rodeffer et al. | 343/786 |
| 6,771,225 B2 | * | 8/2004 | Tits | 343/786 |
| 7,002,528 B2 | * | 2/2006 | Moheb | 343/781 R |
| 2004/0036661 A1 | | 2/2004 | Hanlin et al. | 343/786 |

FOREIGN PATENT DOCUMENTS

| | | |
|---|---|---|
| TW | 282873 | 8/1996 |
| TW | 200301584 | 7/2003 |
| TW | I223467 | 11/2004 |

OTHER PUBLICATIONS

"Single- and Dual-Band Multimode Hard Horn Antennas With Partly Corrugated Walls," Sotoudeh et al., IEEE Transaction on Antennas and Propagation, vol. 54, No. 2, Feb. 2006, pp. 330-339.

* cited by examiner

*Primary Examiner*—Tho G Phan
(74) *Attorney, Agent, or Firm*—Troxell Law Office, PLLC

(57) ABSTRACT

A dual band antenna with a corrugated feed horn comprises a waveguide and a feed horn assembly. The feed horn assembly comprises at least two portions. Two portions each have at least a cylindrical ring and a groove, in which the groove is between two cylindrical rings. By means of adjusting a depth and width of the grooves and a walls width and number of loops of the cylindrical rings of two portions causes each portion responds to different frequency band electromagnetic signal separately and thereby can be adapted to receive radio signals in at least two frequency bands electromagnetic signals. Therefore, this single antenna can be adapted to receive radio signals in two frequency bands. The antenna can effectively reduce manufacturing cost and save space.

9 Claims, 5 Drawing Sheets

DUAL BAND CORRUGATED FEED HORN ANTENNA

BACKGROUND OF THE INVENTION

1. Field of the Invention

The present invention relates to an antenna feed for a satellite receiver and especially relates to an antenna feed which can be adapted to receive two frequency bands electromagnetic signals.

2. Brief Description of Related Art

In general, a satellite receiver, comprises a large satellite dish and a small antenna feed. The antenna feed is located at the focal point of a satellite dish which receives radio signals and reflects them to the antenna feed.

U.S. Pat. No. 6,771,225 disclosed a low cost high performance antenna for use in interactive satellite terminals, in which the antenna feed is an antenna with a corrugated horn feed, which is only able to operate with a single frequency band of electromagnetic wave. U.S. Pat. No. 4,910,527 disclosed a configurable KU-band receiver for satellite antenna feed, in which the antenna feed comprises a configurable KU-band unit and a configurable C-band unit. This antenna feed can be adapted to receive two frequency bands electromagnetic signals.

In general, an antenna feed which is adapted to receive two frequency bands electromagnetic signals mostly comprises two portions. Its structure is more complex; the manufacturing cost is higher and also occupies more space.

SUMMARY OF THE INVENTION

The present invention is provided for simplifying the structure of a dual band antenna feed which is adapted to receive two frequency bands electromagnetic signals.

The main object of the present invention is to provide a dual band antenna with a corrugated feed horn thereby a single antenna can be used for the reception of two frequency bands electromagnetic signals.

Another object of the present invention is to provide a dual band antenna with a corrugated feed horn, in which the antenna structure is compact, and is capable of reducing manufacturing cost and saving space.

The present invention is related to a dual band antenna with a corrugated feed horn, it is used for receiving at least two frequency bands electromagnetic signals, comprising:

a waveguide;

a feed horn assembly, connected to a top end of the waveguide and divided into at least two portions, a first portion thereof being close to an inside thereof, and a second portion thereof being connected to an outside of the first portion; the first portion being provided with at least two cylindrical rings extended upward from the bottom of the feed horn assembly; the second portion being provided with at least two cylindrical rings extended upward from the bottom of the feed horn assembly; the plurality of cylindrical rings being arranged outward from an inner part of the feed horn assembly; a groove being disposed between two adjacent cylindrical rings of the first portion; a place between the cylindrical ring of the first portion and the cylindrical ring of the second portion and a place between two adjacent cylindrical rings of the second portion being all disposed with a groove; the depth of the groove of the first portion being different from the depth of the groove of the second portion.

By adjusting a depth and width of the grooves and a wall width and number of loops of the cylindrical rings of the first and second portions, the first and second portions are respectively allowed to respond the electromagnetic signals of different frequency bands so as to receive at least two frequency bands electromagnetic signals.

Further features and other objects of the present invention will become apparent from the following detailed description, taken in conjunction with the drawings and embodiments.

DETAILED DESCRIPTION OF THE INVENTION

Figure 1A:
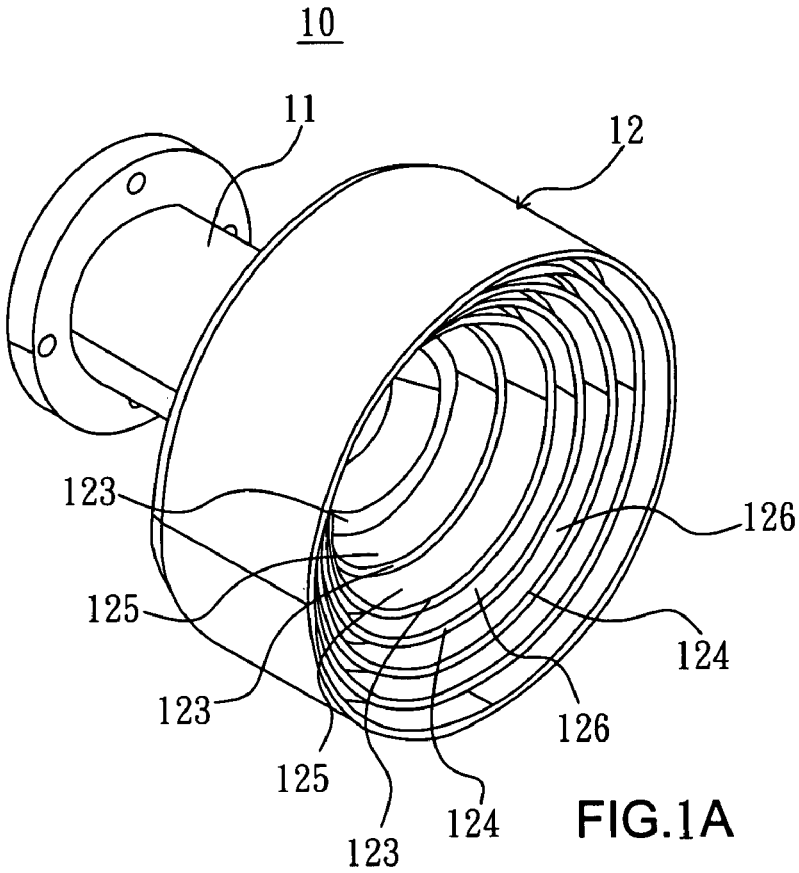
FIG. 1A is a schematic three dimensional view of dual band antenna with a corrugated feed horn in accordance with the first embodiment of the present invention.
Figure 1B:
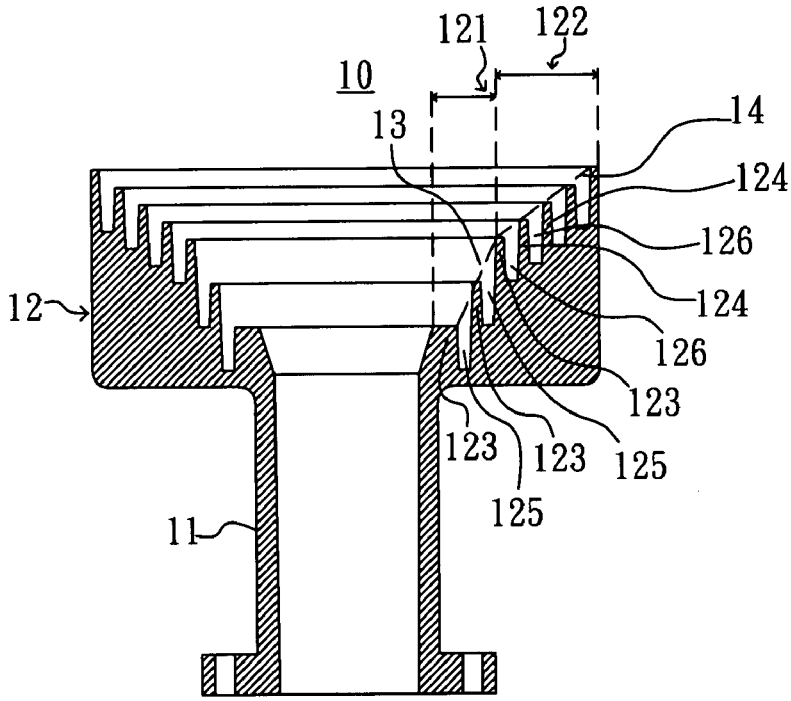
FIG. 1B is a schematic sectional view in accordance with the first embodiment of the present invention.

Please refer to FIGS. 1A, 1B. The dual band antenna with a corrugated feed horn in accordance with the first embodiment of the present invention is provided for adapted to receive two frequency bands electromagnetic signals. This antenna 10 comprises:

a waveguide 11;

a feed horn assembly 12; which connects to the top surface of the waveguide 11. The feed horn assembly 12 and the waveguide 11 can be integrated into one body. The feed horn assembly 12 divides into at least two portions, in which the first portion 121 is near the inside of the feed horn assembly 12, and the second portion 122 connects to the outside of the first portion 121. The first portion 121 includes at least two cylindrical rings 123 which can be extended upward from the bottom of the feed horn assembly 12. The pluralities of cylindrical rings 123 are arranged outward from the feed horn assembly 12. The second portion 122 includes at least two cylindrical rings 124 which can be extended upward from the bottom of the feed horn assembly 12. The first portion 121 includes grooves 125. The groove 125 is between two adjacent cylindrical rings 123. Likewise, there is groove 126 between two cylindrical rings 123, 124 of the first and second portions 121, 122 and also has a groove 126 between two adjacent cylindrical rings 124 of the second portion 122. The depth of the first groove 125 of the first portion 121 is different than the second groove 126 of the second portion 122. And the groove 125 of the first portion 121 is deeper than the groove 126 of the second portion 122 in this embodiment.

By means of adjusting the depth and width of the grooves 125, 126 and the walls width and number of loops of the cylindrical rings 123, 124 of the first and second portions 121, 122, cause the first and second portions 121, 122 can respond the electromagnetic signals of different frequency bands separately at the same time. For example, causes the first portion 121 receives or radiates the first frequency band. Likewise, causes the second portion 122 receives or radiates the second frequency band. The frequency of the first frequency band may be higher than the frequency of the second frequency band. The frequency of the first frequency band also may be lower than the frequency of the second frequency band. And it can adjust a return loss, 10 db beam width of beam and a side lobe level of the antenna 10.

In accordance with this embodiment, the slope rate of the first virtual straight line 13 which is connected to the upper edge of the plurality of grooves 12 of the first portion 121, is set as A. The slope rate of the virtual straight line 14 which is connected the upper edge of the plurality of grooves 12 of the second portion 122, is set as B, wherein A>B.

The caliber size of the waveguide 11 is determined by the lower frequency band electromagnetic signals according to the present invention. The caliber size and heights of the exit of the feed horn assembly 12 are two adjustable parameters. They can be adjusted with the return loss, 10 db beam width of beam and the side lobe level of the antenna 10.

Figure 2A:
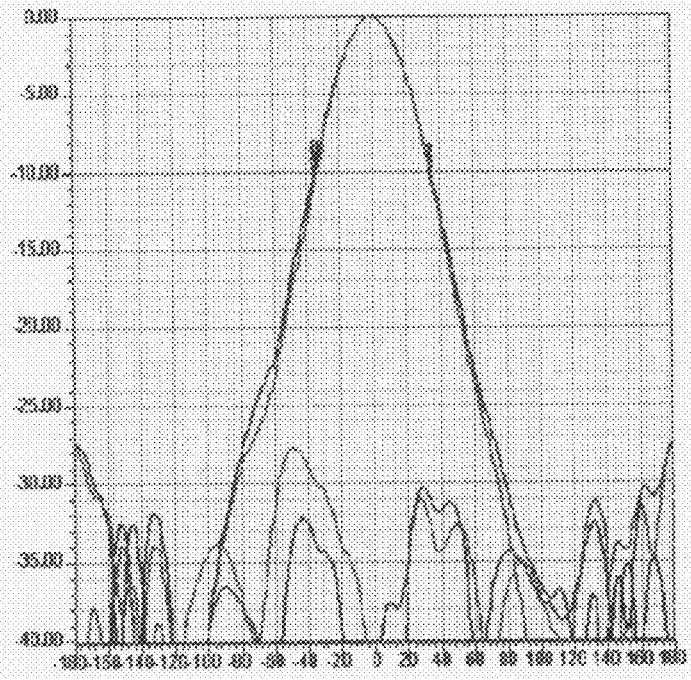
FIG. 2A is an antenna radiation pattern with left hand circular polarization of electromagnetic radiation which is obtained by executing an operation of radiation simulation at a radio frequency of 12.45 GHz in accordance with the first embodiment of the present invention.

Refer to FIG. 2A. An antenna radiation pattern (show in FIG. 2A) with left hand circular polarization of electromagnetic radiation is obtained by executing an operation of radiation simulation at a radio frequency of 12.45 GHz in accordance with the embodiment of the antenna 10 of the present invention. The above mentioned curves are wave components. One of them is vertical component wave, the other is horizontal component wave, and the lower curve is a side lobe; as shown in the FIG. 2A, a radiation operating in the 12.45 GHz frequency band. It shows that the vertical component wave and horizontal component wave have similar major beam shape. Both 10 db beam width of beam which 10 db goes downward the wave crests respectively are 70.0° and 68.0°. The side lobes underneath the beams are smaller than the major wave crest. It shows that antenna 10 has good radiation efficiency in the 12.45 GHz frequency band.

Figure 2B:
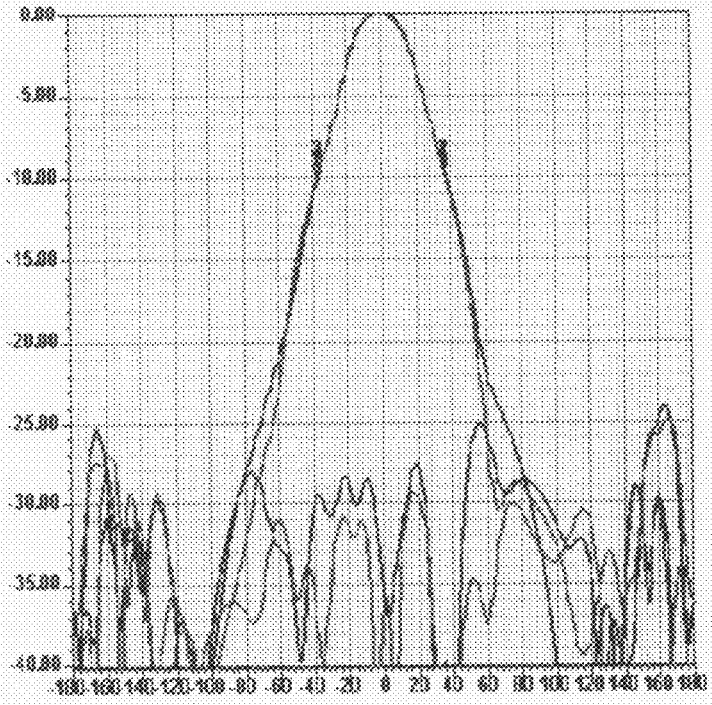
FIG. 2B is an antenna radiation pattern with left hand circular polarization of electromagnetic radiation which is obtained by executing an operation of radiation simulation at a radio frequency of 19.95 GHz in accordance with the first embodiment of the present invention.

Refer to FIG. 2B. An antenna radiation pattern (show in FIG. 2B) with left hand circular polarization of electromagnetic radiation is obtained by executing an operation of radiation simulation at a radio frequency of 19.95 GHz in accordance with the embodiment of the antenna 10 of the present invention. The above mentioned curves are wave components. One of them is vertical component wave, the other is horizontal component wave, and the lower curve is a side lobe; as shown in the figure, a radiation operating in the 19.95 GHz frequency band. It shows that the vertical component wave and horizontal component wave have similar major beam shape. The 10 db beam width of the major beam for the vertical and horizontal component waves are 74.0° and 73.0°. The side lobes underneath the beams are smaller than the major wave crest. It shows that antenna 10 has good radiation efficiency in the 19.95 GHz frequency band.

Figure 3A:
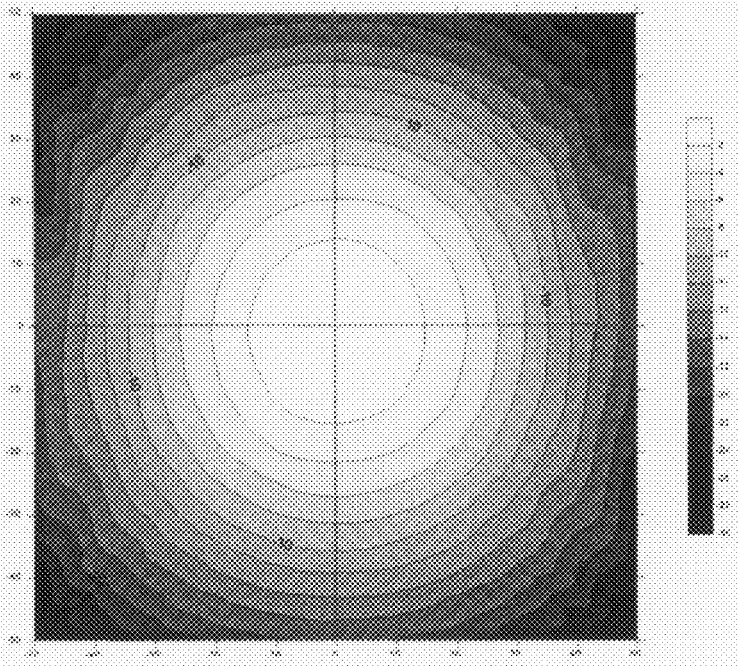
FIG. 3A is an antenna radiation pattern with left hand circular polarization of electromagnetic radiation which is obtained by executing an operation of radiation at a radio frequency of 12.45 GHz in accordance with the first embodiment of the present invention.

Refer to FIG. 3A. An antenna radiation pattern (show in FIG. 3A) with left hand circular polarization of electromagnetic radiation is obtained by executing an operation of radiation at a radio frequency of 12.45 GHz in accordance with the embodiment of the antenna 10 of the present invention. The above mentioned curves are wave components; as shown in the figure, a radiation operating in the 12.45 GHz frequency band. The 10 db beam width of the major beam for the vertical and horizontal component waves are 69.5° and 69.5°. It shows that antenna 10 has good radiation efficiency in the 12.45 GHz frequency band.

Figure 3B:
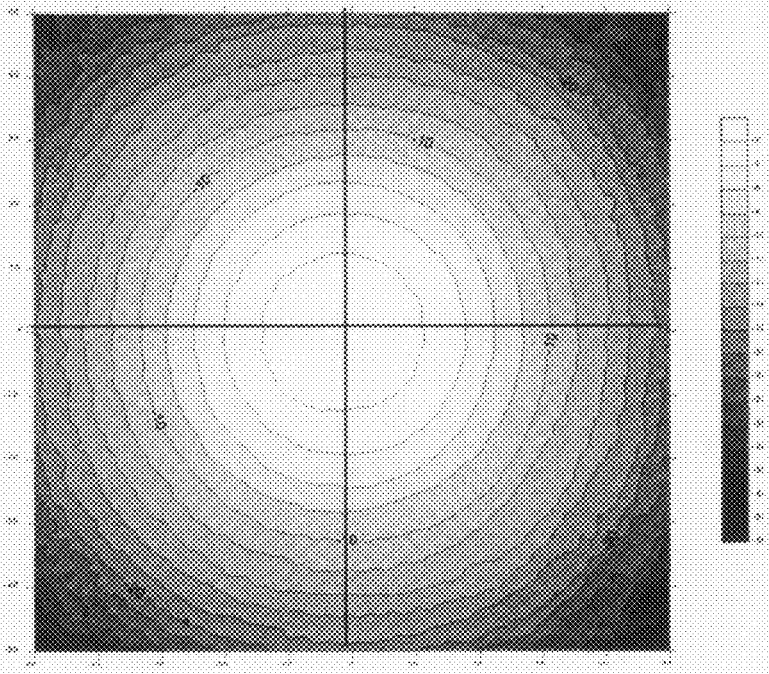
FIG. 3B is an antenna radiation pattern with left hand circular polarization of electromagnetic radiation which is obtained by executing an operation of radiation at a radio frequency of 19.95 GHz in accordance with the first embodiment of the present invention.

Refer to FIG. 3B. An antenna radiation pattern (show in FIG. 3B) with left hand circular polarization of electromagnetic radiation is obtained by executing an operation of radiation at a radio frequency of 19.95 GHz in accordance with the embodiment of the antenna 10 of the present invention; As shown in the figure, a radiation operating in the 19.95 GHz frequency band. The 10 db beam width of the major beam for the vertical and horizontal component waves are 65.0° and 64.5°. It shows that antenna 10 has good radiation efficiency in the 19.95 GHz frequency band.

By means of the above mentioned actual and simulative survey result. The antenna 10 is actually able to respond to two frequency bands at 12.45 GHz and 19.95 GHz simultaneously. The shape of the major beam and the 10 db beam width of beam is exactly the same respectively. It shows that antenna 10 has good radiation efficiency in both 12.45 GHz and 19.95 GHz frequency bands.

Figure 4A:
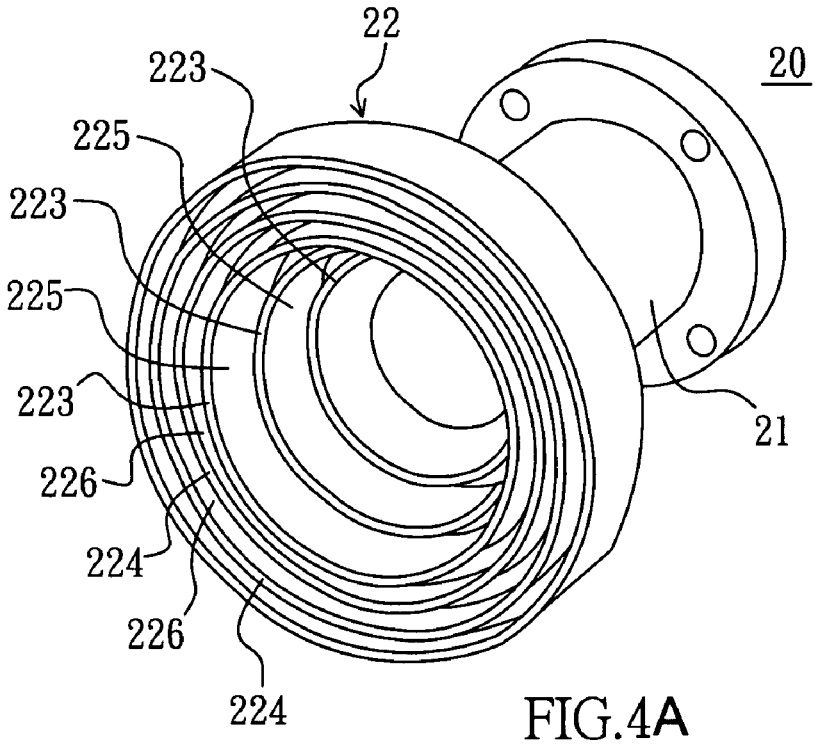
FIG. 4A is a schematic three dimensional view of a dual band antenna with a corrugated feed horn in accordance with the second embodiment of the present invention.
Figure 4B:
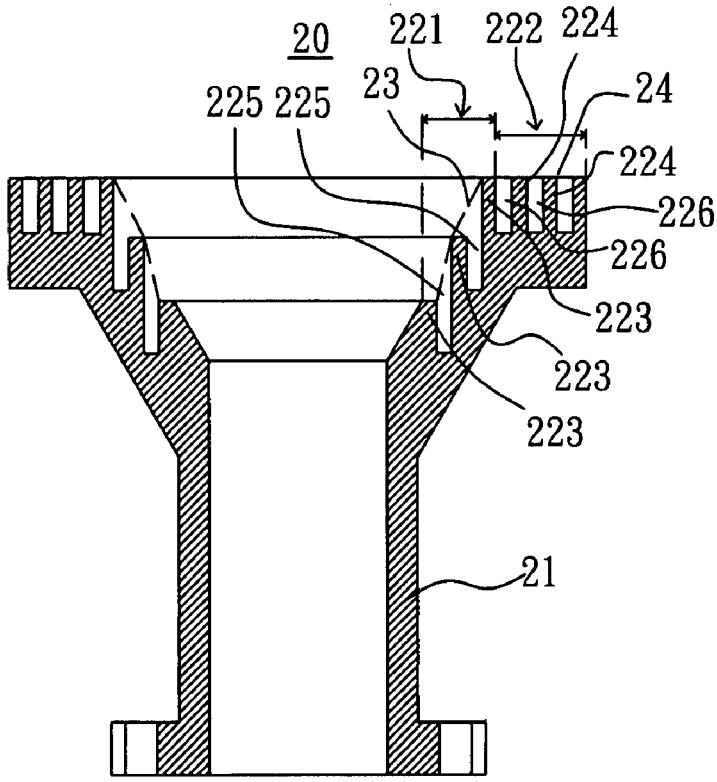
FIG. 4B is a schematic sectional view in accordance with the second embodiment of the present invention.

Please refer to FIGS. 4A, 4B. The dual band antenna with a corrugated feed horn in accordance with the second embodiment of the present invention is provided for adapted to receive radio signals in two frequency bands of electromagnetic waves. This antenna 20 comprises:

a waveguide 21;

a feed horn assembly 22, which connects to the top surface of the waveguide 21. This feed horn assembly 22 can be integrated into the waveguide 21. The feed horn assembly 22 divides into at least two portions, in which the first portion 221 is near the inside of the feed horn assembly 22, and the second portion 222 connects to the outside of the first portion 221. The first portion 221 includes at least two cylindrical-rings 223 which can be extended upward from the bottom of the feed horn assembly 22. The pluralities of cylindrical-rings 223 are arranged in an order of outward direction from the inner side of the feed horn assembly 22. The second portion 222 includes at least two cylindrical-rings 224 which can be extended upward from the bottom of the feed horn assembly 22. The pluralities of cylindrical-rings 224 are arranged in an order of outward direction from the inner side of the feed horn assembly 22. The first portion 221 includes a groove 225 which is between the adjacent cylindrical-rings 223. Likewise, there is groove 226 between the cylindrical-rings 223, 224 of the first and second portions, and also has a groove 226 between the adjacent cylindrical-rings 224 of the second portion. And the groove 225 of the first portion 221 is deeper then the groove 226 of the second portion 222 in this embodiment.

By means of adjusting the depth and width of the grooves 225, 226 and the walls width and number of loops of the cylindrical-rings 223, 224 of the first and second portions 221, 222, cause the first and second portions 221, 222 can respond the electromagnetic waves of different frequency bands separately at the same time. For example, causes the first portion 221 receives or radiates the first frequency band. Likewise, causes the second portion 222 receives or radiates the second frequency band. And it can adjust a return loss, 20 db beam width of beam and a side lobe level of the antenna 20.

In accordance with this embodiment, the slope rate of the first virtual straight line 23 which is connected the upper edge of the plurality of grooves 22 of the first portion 221, set as C. The slope rate of the virtual straight line 24 which is connected the upper edge of the plurality of grooves 22 of the second portion 222, set as D, wherein C>D and D=0.

The caliber size of the waveguide 21 is determined by the lower frequency band electromagnetic signal according to the present invention. The caliber size and heights of the exit of the feed horn assembly 22 are two adjustable parameters. It can be adjusted with the return loss, 10 db beam width of beam and the side lobe level of the antenna 20.

Figure 5A:
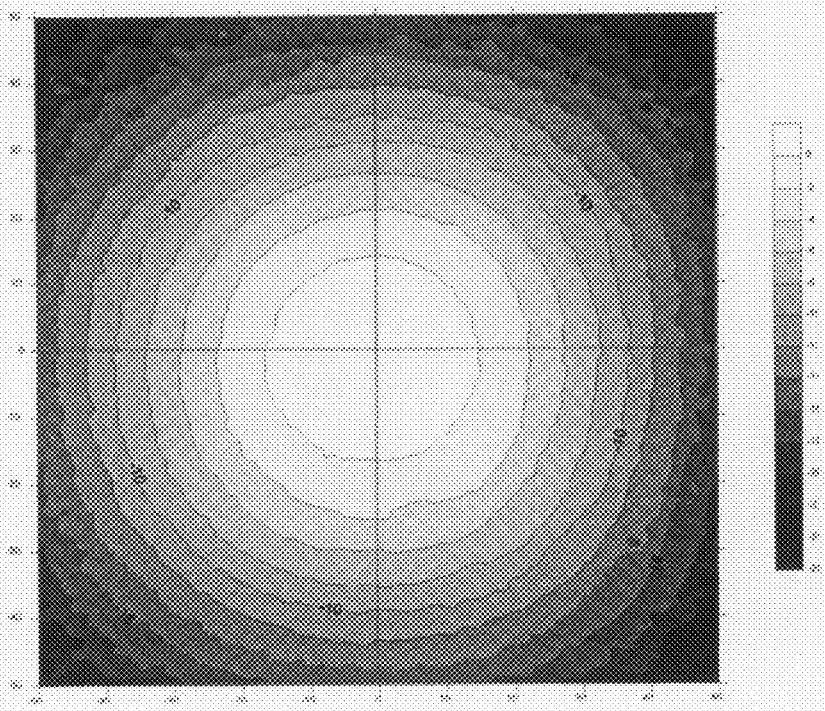
FIG. 5A is an antenna radiation pattern with right hand circular polarization of electromagnetic radiation which is obtained by executing an operation of radiation at a radio frequency of 20 GHz in accordance with the second embodiment of the present invention.

Refer to FIG. 5A. An antenna radiation pattern (show in FIG. 5A) with right hand circular polarization of electromagnetic radiation is obtained by executing an operation of radiation at a radio frequency of 20 GHz in accordance with the embodiment of the antenna 20 of the present invention. As shown in FIG. 5A, when an antenna radiates in the 20 GHz frequency band, the 10 db beam width of the major beam for the vertical and horizontal component waves are 75.5° and 74.0°. It shows that the antenna 20 has good radiation efficiency in the 20 GHz frequency band.

Figure 5B:
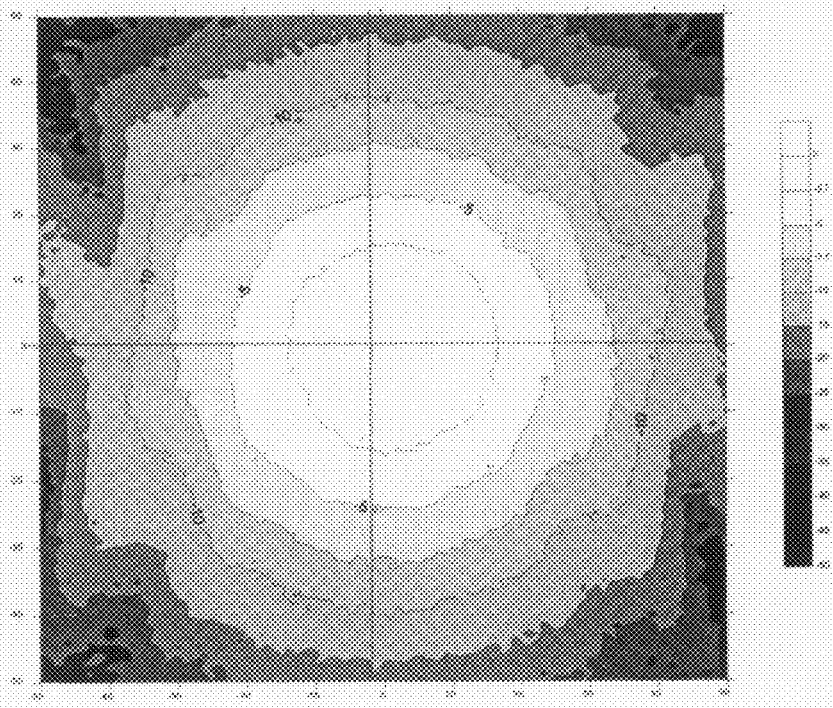
FIG. 5B is an antenna radiation pattern with right hand circular polarization of electromagnetic radiation which is obtained by executing an operation of radiation at a radio frequency of 30 GHz in accordance with the second embodiment of the present invention.

Refer to FIG. 5B. An antenna radiation pattern (show in FIG. 5B) with right hand circular polarization of electromagnetic radiation is obtained by executing an operation of radiation at a radio frequency of 30 GHz in accordance with the embodiment of the antenna 20 of the present invention. As shown in FIG. 5B, a radiation operating in the 30 GHz frequency band, the 10 db beam width of the major beam for the vertical and horizontal component waves are 76.0° and 77.0° respectively. It shows that antenna 20 has good radiation efficiency in the 30 GHz frequency band.

By means of the above mentioned actual survey result. The antenna 20 is really able to respond to two frequency bands at 20 GHz and 30 GHz simultaneously. The shape of the major beam and the 10 db beam width of beam is exactly the same respectively. It shows that antenna 20 has good radiation efficiency in both 20 GHz and 30 GHz frequency bands.

The present invention is provided with a dual band corrugated feed horn antenna. This unitary antenna can be adapted to receive two bands electromagnetic signals. Thus the structure is compact and this device can effectively reduce manufacturing cost and save space on antenna.

In accordance with the present invention, the feed horn assembly is capable of being divided into three portions. Each portion comprises a cylindrical-ring and a groove. According to the technologies mentioned above in alternate embodiments, this unitary antenna can operate in three frequency bands.

The above described embodiments are for explaining technical concepts and features. Those skilled in the art will appreciate that with various modifications, substitution is possible, without departing from the scope of the inventions which are disclosed in the accompanying claims.

What is claimed is:

1. A dual band antenna with a corrugated feed horn, used for receiving at least two frequency bands electromagnetic signals, comprising:

a waveguide;

a feed horn assembly, connected to a top end of the waveguide and divided into at least two portions, a first portion thereof being close to an inside thereof, and a second portion thereof being connected to an outside of the first portion; the first portion being provided with at least two cylindrical rings extended upward from the bottom of the feed horn assembly; the second portion being provided with at least two cylindrical rings extended upward from the bottom of the feed horn assembly; the plurality of cylindrical rings being arranged outward from an inner part of the feed horn assembly; a groove being disposed between two adjacent cylindrical rings of the first portion; a place between the cylindrical ring of the first portion and the cylindrical ring of the second portion and a place between two adjacent cylindrical rings of the second portion being all disposed with a groove; the depth of the groove of the first portion being different from the depth of the groove of the second portion;

whereby, by adjusting a depth and width of the grooves and a wall width and number of loops of the cylindrical rings of the first and second portions, the first and second portions are respectively allowed to respond the electromagnetic waves of different frequency bands so as to receive at least two frequency bands electromagnetic signals.

2. The dual band antenna with a corrugated feed horn according to claim 1, wherein the groove of the first portion is deeper than the groove of the second portion.

3. The dual band antenna with a corrugated feed horn according to claim 2, wherein a slope rate of a first virtual straight line which connects to the upper edge of the plurality of grooves of the first portion is larger than a slope rate of a virtual straight line which connects to the upper edge of the plurality of grooves of the second portion.

4. The dual band antenna with a corrugated feed horn according to claim 3, wherein the slope rate of the virtual straight line which connects to the upper edge of the plurality of grooves of the second portion is zero.

5. The dual band antenna with a corrugated feed horn according to claim 4, wherein the antenna is an integral whole.

6. The dual band antenna with a corrugated feed horn according to claim 1, wherein the antenna is an integral whole.

7. The dual band antenna with a corrugated feed horn according to claim 1, wherein a slope rate of a first virtual straight line which connects to the upper edge of the plurality of grooves of the first portion is larger than a slope rate of a virtual straight line which connects to the upper edge of the plurality of grooves of the second portion.

8. The dual band antenna with a corrugated feed horn according to claim 7, wherein the slope rate of the virtual straight line which connects to the upper edge of the plurality of grooves of the second portion is zero.

9. The dual band antenna with a corrugated feed horn according to claim 8, wherein the antenna is an integral whole.

* * * * *